United States Patent [19]

Rushton, Jr.

[11] Patent Number: 4,958,385

[45] Date of Patent: Sep. 25, 1990

[54] HAIR DRESSING HEADBAND

[76] Inventor: Robert C. Rushton, Jr., 739 Barry Dr., Springfield, Pa. 19064

[21] Appl. No.: 329,275

[22] Filed: Mar. 27, 1989

[51] Int. Cl.[5] ..... A41D 13/00

[52] U.S. Cl. ..... 2/174; 2/181; 2/DIG. 11

[58] Field of Search ..... 2/174, 171.8, 179, 196, 2/63, 209.4, 209.5, 181, 181.6, 182.3, 192, 200; 132/212, 270

[56] References Cited

U.S. PATENT DOCUMENTS

| | | | |
|---|---|---|---|
| 579,394 | 3/1897 | Iles | 2/181 |
| 1,391,902 | 9/1921 | Martin | 2/181 |
| 1,597,558 | 4/1925 | Walters | 2/181 |
| 1,664,307 | 9/1926 | Millard | 2/181 |
| 1,986,312 | 1/1935 | Wilson | 2/63 |
| 2,024,366 | 7/1935 | Israel | 2/63 |
| 2,106,075 | 1/1938 | Tabley | 2/181 |
| 2,640,198 | 6/1953 | Mullen | 2/174 |
| 4,441,214 | 4/1984 | Werner et al. | 2/174 |
| 4,502,156 | 3/1985 | Wishman | 2/181 |
| 4,656,671 | 4/1987 | Manges | 2/174 |

*Primary Examiner*—Werner H. Schroeder
*Assistant Examiner*—Gloria Hale
*Attorney, Agent, or Firm*—Eugene E. Renz, Jr.

[57] ABSTRACT

A headband device fo absorbing liquids used with hair dressing treatments. A fluid impervious barrier layer is formed into a strip which extends for a distance greater than the circumference of the head. The strip has a width sufficient to define an absorbent region and a sealing region. Also provided is an adhesive layer applied to the absorbent region of the inside of the strip. A layer of superabsorbent material is placed in the absorbent region of the strip and is held in place by the adhesive. A moisture pervious fibrous stock is attached to the strip to cover the super absorbent and is exposed on the inside of the strip for contact with the head. The sealing region of the strip is bonded to the fibrous stock along the length of the strip and at the terminal ends. Flow of liquids such as perm solutions are limited to the absorbent region solely through the fibrous stock. The device is adjustable for fastening to a person's head to absorb hair coloring agents, perm solutions and the like.

25 Claims, 1 Drawing Sheet

HAIR DRESSING HEADBAND

FIELD OF THE INVENTION

The present invention relates to headbands suitable for absorbing liquids used with hair dressing treatments. More particularly, the present invention relates to a device which is admirably suited for absorbing permanent wave solutions or hair coloring solutions which otherwise have a tendency to cause skin irritation surrounding the hairline (flare-up) or other adverse effects on the skin.

BACKGROUND OF THE INVENTION

Convèntional hair dressing treatment involves the use of coloring agents, permanent wave solutions, and other treating liquids. These solutions alter one or more characteristics of a person's hair. Solutions are kept in contact with the hair for sufficient time to complete the treatment.

Particularly in beauty salons, where one beautician treats a number of customers at one time, hairdressing treatment solutions may be in contact with a person beyond the necessary minimum time for completion of the procedure. Permanent wave solutions which cause the hair to assume a desirable curl or wavelike pattern are alkaline in nature. Similarly, coloring solutions often are alkaline. While these solutions are normally safe when properly used, some people have a particular sensitivity to one or more of the many chemical hairdressing solutions presently on the market. Often times, this sensitivity manifests itself in an irritation of the skin surrounding the hairline which is commonly called "flare-up". Because exposed skin is sometimes more sensitive than the scalp is, flare-up occurs along the back of the neck and across the forehead. Moreover, even if the flare-up is mild and not harmful, temporary streaks of red on the face or neck are unsightly and detract from initial approval of the hair dressing treatment.

The principal method for reducing or eliminating flare-up and other adverse effects from hair dressing treatments is the use of cotton ropes or other absorbent materials which are used to pack the area adjacent the hair line and absorb the solution so that it does not run down onto the exposed skin of the customer. This procedure is at best partially effective for some of the beauty shop patrons. Clients who are more sensitive are subjected to flare-up even when the beautician is extremely careful and quick with the application of cotton or other blotting materials during the chemical treatments. Some customers forego certain treatments because of above normal sensitivity either initially or after repeated treatments. In addition, the beautician is required to expend an inordinate amount of time in order to prevent flare-up and other side effects from the treatments with the present cotton packing method.

One method which has been used to minimize the adverse affects on a person's skin during hair treatment is the messy, but somewhat effective, procedure of using petroleum jelly or other greasy products to form a protective area at the hair line. Often times, a cotton strip or rope is used in combination with this layer of protective grease. The cotton strip or rope is approximately one inch in diameter and about two feet long, and is wrapped around the head of the customer at the hair line to absorb the various treating solutions as they are applied. It is awkward to use and becomes very messy and cumbersome when saturated with liquid.

Because typical hair treatment processes may involve three or four applications of solutions and because the conventional cotton products often are saturated, three or four or more of these cotton ropes are employed during a typical permanent wave application. In spite of every precaution, however, irritating and messy solutions drip down onto the person's neck and cheek, potentially endangering the eyes and ears. Almost always, the cotton ropes fail to keep the solution from contacting the skin as it drains from the hair to the scalp and then down the head of the person.

Other materials have generally been used to absorb liquids but none of these alternative articles of manufacture have been found to be useful in the hair dressing industry. For example, U.S. Pat. No. 4,077,410 describes a disposable absorbent pad which may be used for diapers, surgical dressings and the like. This patent contains no suggestion that alkaline fluids such as often employed in the hair dressing industry might be absorbed.

Similarly, U.S. Pat. No. 4,055,184 describes an absorbent pad which uses a hydrolyzed starch copolymer in combination with a water soluble material. There is no suggestion that such a device would be useful in the hair dressing industry.

U.S. Pat. No. 4,502,156 describes a non-woven polypropylene fabric which is used to absorb liquids. One use of this design is as a hat band, presumably because the design is capable of temporarily holding a quantity of moisture which would then evaporate or otherwise be removed during non-use of the hat. Similarly, headbands and wristbands for atheletic competition are suggested, but these designs do not seal in the moisture or prevent leakage. There is no recognition that their is a need to keep the fluids away from contact with that part of the body to which the pad has been applied. The patent appears to describe reuseable articles in which moisture that has been absorbed must be removed. Clearly, there is no suggestion that the apparatus would be useful in the hair dressing industry.

Finally, U.S. Pat. No. 4,770,298 describes a pad having a complicated structure which is designed to fit various body shapes. There is no mention that the material might be useful for hair dressing applications. There is a specific recognition that garments formed from flat sheets have low absorbtion and are likely to cause discomfort. There is a disclosure of superabsorbent materials generally, which are conventionally known materials which absorb many times their own weight in fluids.

At the present time, no product is available which is capable of substantially reducing or eliminating skin irritation from chemical hair services. Accordingly, it is an object of this invention to provide such a device in as economical and efficient a manner as possible.

SUMMARY OF THE INVENTION

It has now been discovered that the above and other objects of the present invention can be accomplished by construction of a device in accordance with the following principles. Specifically, a head band device has been discovered which is suitable for absorbing liquids used with hair dressing treatments such as permanents waves, coloring and the like. The device is economical to construct and for that reason is disposable after being filled with liquid, yet it is not messy when removed.

The device includes a fluid impervious barrier layer which is formed into a strip extending for a distance greater than the circumference of a person's head. The strip has a width which is sufficient to define both an absorbent holding region and a sealing region. A moisture pervious fibrous stock is also attached to the strip and defines an inside facing region adjacent the absorbent holding region of the strip. An adhesive layer is applied to the absorbent region of the inside of the strip. A layer of superabsorbent material is applied and is held in place by the adhesive. The moisture pervious fibrous stock is exposed on the inside of the strip for contact with the head, to absorb liquids. Also, there is a means provided for bonding the sealing region of the strip at least to the fibrous stock along the length of the strip and for sealing the terminal ends of the strip. This bonding limits the flow of liquid to the absorbent region only through the fibrous stock and traps the liquid in the absorbent region. Finally, adjustable means for fastening the strip to a person's head are provided so as to present the fibrous stock in contact with the person's head.

Typically, the barrier layer is formed from a film which is made from polypropylene, polyethylene and/or mixtures thereof. A preferred film for forming the barrier layer is polypropylene, particularly where polypropylene is a two temperature co-extrusion film having an inner side with a lower melting point. The inner side can be heat sealed without adversely affecting the appearance of the outer side of the barrier layer. The ends are also sealed by means of a heat seal, such as by a heated head and anvil arrangement.

In a preferred embodiment, the superabsorbent is a particulate material which is contacted by the adhesive layer. In a preferred embodiment the adhesive layer is contacted with the particulate superabsorbent to provide a predetermined pattern thereon. Ideally, the pattern is sufficient to provide a single crystal or particle layer thickness with sufficient space between the particles to permit full expansion of the superabsorbent when it contacts the liquid. A fully disposable product protests the use without rewetting.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
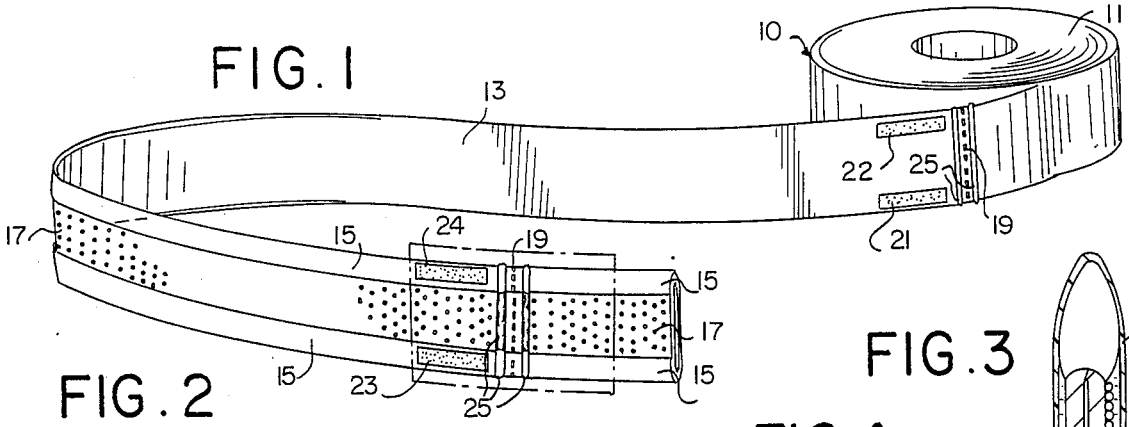
FIG. 1 is a perspective view showing a roll of interconnected, fluid absorbent, headbands, to be utilized by beauticians, in accordance with this invention.

Shown generally by the reference numeral 10 in FIG. 1 is a roll of interconnected, fluid absorbent headbands according to the present invention. The headbands are provided in a roll 11 which contains a plurality of single headbands 13. The roll 11 can be contained in suitable packaging for use storage and dispersed as needed in beauty shops and the like.

Individual headbands 13 manufactured from a fluid impervious barrier layer which has been formed into a strip extending for a distance greater than the circumference of the head. The strip 13 includes a fold over portion 15 or overlap, which allows for sealing as described hereinafter. Enclosed within the strip 13 by the overlap 15 is a moisture pervious fibrous stock 17 which has an outside contact region for contacting the person's head. Perforations 19 allow individual headbands 13 to be separated from the roll 11.

Figure 5:
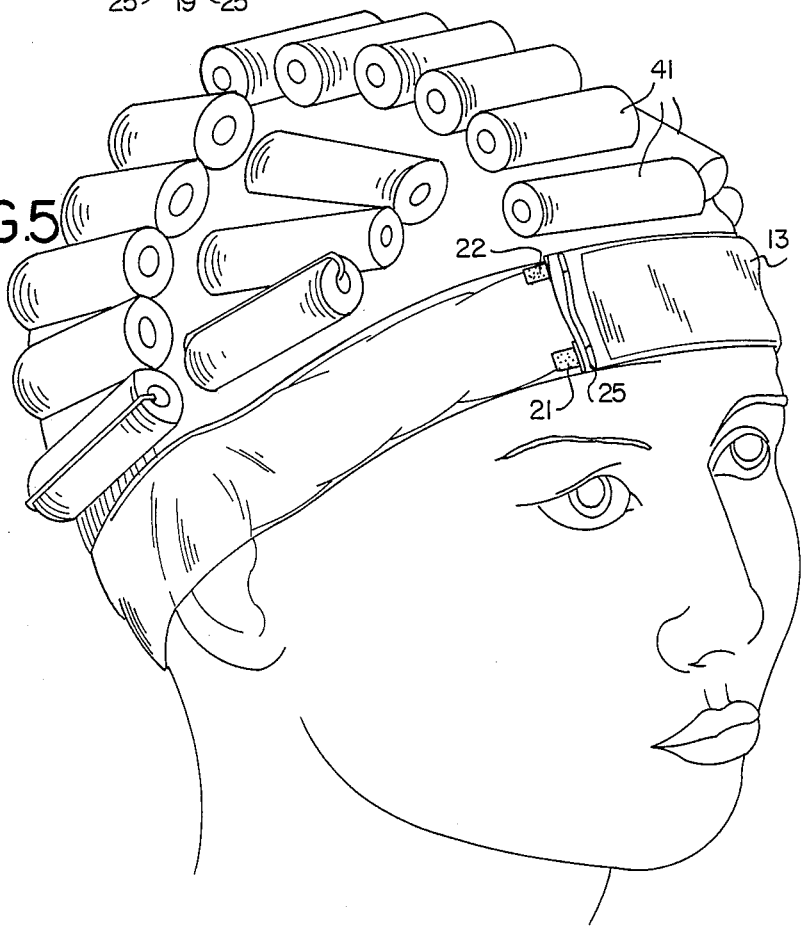
FIG. 5 is a perspective view showing the headband of this invention as applied to a customer.

The headband itself is fastened to a person's head using adhesive strips. Adhesive strips 21 and 22 are shown in FIG. 1 near the roll 11 of individual strips 13 and are located on the outside of the headband. Strips 21 and 22 cooperate with adhesive strips 23 and 24 which are located at the other end and on the inside fold 15 of headband 13. By suitably selecting the length of strips 21, 22, 23 and 24, varying head sizes can be accommodated. Attachment of the headband to a person as shown in FIG. 5 can easily be accomplished by quickly wrapping the headband 13 about the head so that the contact region of the fibrous stock 17 is in contact with the person's head. The contact adhesives 21, 22, 23 and 24 are then brought together and the headband 13 is held firmly in place. The particular form of the adhesive strips 21 through 24 is a matter of choice. Many contact adhesives are presently available and can be applied using ordinary assembly procedures.

Figure 2:
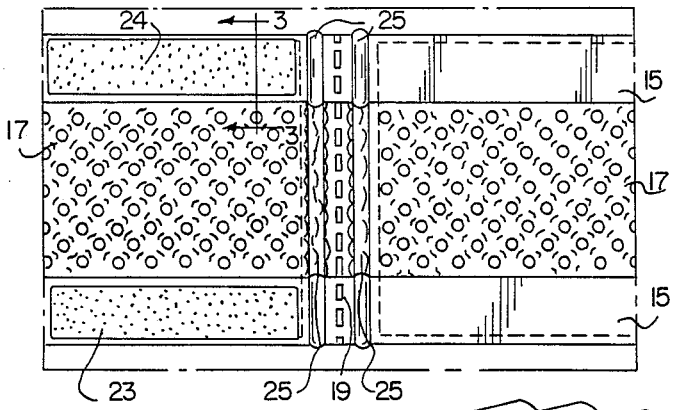
FIG. 2 is an enlarged fragmentary plan view of the portion of the headband tape within the dot and dash rectangle shown in FIG. 1 and designated FIG. 2 illustrating certain details of the absorbent face of the headband of this invention.

As shown in FIG. 2 in enlarged detail, a plurality of seals 25 are positioned on each side of the perforation 19 to provide a sealed terminal edge across the entire width of the headband and to facilitate separation of the individual headbands 13 without damage. The seal 25 can be heat actuated, by melting the headband 13, inside fold 15 and fibrous stock 17 on a die and anvil device, for example, or by terminating the end with adhesive.

Figure 3:
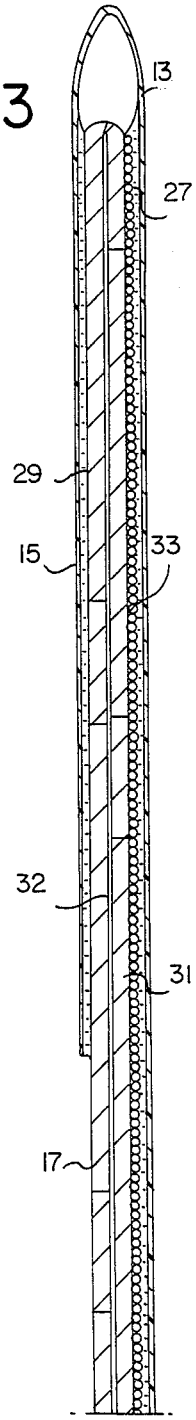
FIG. 3 is a greatly enlarged fragmentary sectional view taken on the line 3,3 of FIG. 2 showing the layered construction of the headband.

As is more clearly shown in FIG. 3, the headband 13 and overlap 15 form an outside impervious barrier for the device generally. The headband exterior 13 is made from a fluid impervious barrier such as polypropylene, polyethylene, and/or mixtures of polyethylene and polypropylene. These materials are relatively inexpensive and easy to fabricate. The fibrous stock 17 is held in place against the inside or absorbent region of the strip 13 and is in contact with the inside of the strip 13 across what is defined as an absorbent region. This absorbent region is the area on the inside of the strip 13 which faces toward the head when the headband is in use. A layer of adhesive 27 is supplied to the inside, absorbent side of the impervious strip 13. The embodiment shown in FIG. 3 shows the adhesive layer 27 applied to the inside absorbent region of the strip 13. In another embodiment, this adhesive layer 27 could be applied to the area of the fibrous stock 17 which would otherwise be in direct contact with the area of strip 13 which is presently covered by adhesive layer 27.

The overlap end 15 of the strip 13 is also bonded to the fibrous stock 17, using an adhesive layer 29. This adhesive layer may optionally be applied to either the overlap 15 or the fibrous stock 17 as desired. Alternatively, it may be desirable to heat seal the overlap area 15 directly onto the fibrous stock 17, thereby eliminating the need for adhesive layer 29.

Depending upon the particular grade of fibrous stock 17, it may be desirable to fold the fibrous stock 17 to provide a second layer 31. In this manner, a spacing 32 between the fibrous stock layers 17 and 31 provides an additional barrier against re-wetting or reverse flow of the fluids back out from the absorbent region of the headband 13.

Also contained between the fibrous stock 17 and the absorbent region of the strip 13 is a quantity of superabsorbent material 33, which is shown in detail in FIG. 3 as being a particulate material. Superabsorbent materials are currently available in a variety of forms. One particular preferred superabsorbent material is marketed by the Grain Processing Corporation of Muscatine, Iowa under the tradename WATER-LOCK TM J-500. The product is a white, free flowing powder having the ability to absorb or immobilize large volumes of aqueous solutions including dilute alkalis, dilute acids and body fluids. Typically, these powders absorb at least 500 millimeters of water per gram of powder. Although the product often times becomes slippery when wet, in the present design where it is isolated from contact by placement between the fibrous stock 17 and the absorbent region of the headband 13, contact with the person is avoided. The superabsorbent provides a wicking action, drawing fluid through the fibrous stock 17.

As is clear from FIG. 3, the superabsorbent 33 and the adhesive layer 27 could be reversed. In this circumstance, however, the adhesive 27 would need to be water permeable as well to permit access of the fluids to the superabsorbent material 33. The present design as shown in FIG. 3, has the advantage that the adhesive 27 adds additional moisture permeability resistance and strengthens the relatively thin outer layer of the headband 13. The fibrous stock 17 has greater tear resistance, normally, and does not need additional support.

Figure 4:
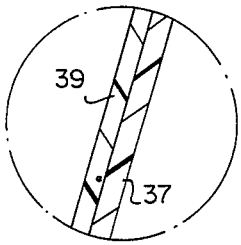
FIG. 4 is a greatly enlarged fragmentary section view of the detail within the dot and dash circle of FIG. 3 and designated FIG. 4 illustrating a modified form of outer envelope, construction.

In one preferred embodiment, the fluid impervious barrier layer formed into the headband strip 13 and extending with overlap 15 can be manufactured from polypropylene using a two temperature co-extrusion process. The outside layer functions as a vapor barrier more effectively, since its melting point is higher such as at 39 shown in FIG. 4. The inside or lower melting layer 37 as shown in FIG. 4 can be attached using a hot melt process to attach to the fibrous stock 17 in place of additional adhesive 29.

During the manufacturing process, the barrier layer is formed from a fluid impervious film to provide a strip having a sufficient width to define an absorbent region and a sealing region. The absorbent region is that region of the inside of the headband 13 which will be contacted by the fibrous stock after the product is manufactured. Using a knife over roll coater, the adhesive 27 can be printed on the inside of the strip. Once the adhesive layer 27 has been applied, the superabsorbent 33 is applied, preferably by gravure printing a particular pattern of superabsorbent particulate or crystals. When the superabsorbent is particulate in nature and when it is printed on the adhesive, a particular advantages is obtained by providing sufficient space for the superabsorbent crystals to expand and thereby maximize the amount of fluid which can be absorbed by the device. The particulate superabsorbent can be printed or otherwise placed on the adhesive in a random pattern or it may have a predetermined pattern to ensure ideal spacing between the crystals.

Once the fibrous stock 17 has been applied to the superabsorbent 33 and adhesive layer 27, the overlap or sealing region 15 of the headband 13 is folded over and sealed against the fibrous stock 17. As previously discussed, either a hot melt seal or an adhesive such as adhesive 29 can be employed to bond the overlap 15 to the fibrous stock 17. Any fibrous stock which is suitable for allowing fluid to pass through, such as diaper stock, incontinent stock and the like may be employed. Typically, the fibrous stock is a non-woven fabric. The function of this layer is to allow the moisture to pass through to the superabsorbent 33, wherein the superabsorbent absorbs all of the fluid to prevent rewetting back through the fibrous stock 17. Perforations 19 and hermetic terminal end seals 25 are formed and the rolled product is complete.

The device of the present invention is now suitable for use by hairdressers. Typically, after the hair has been washed and set in rollers, such as curlers 41, the headband device 13 is applied using the adhesive strips as previously described. The perm solution, for example, is then applied and as the fluid drains down the head, it is drawn into the fibrous stock 17, contacts the superabsorbent crystals 33 and is absorbed. When the initial applications is completed, and a majority of the hair dressing solution has been absorbed by the crystals 33, it may or may not be desirable to remove the saturated headband 13 and replace it with a second headband to collect additional moisture as it drains more slowly from the curlers. This is always necessary when the previously described cotton ropes are employed, not only because additional fluid is likely to drain from the curlers, but primarily because the cotton ropes do not keep the fluid which has been absorbed away from contact with the customer's skin. Tests have shown that this immediate replacement step is not necessary using the devices of the present invention. Prior art treatments have always required that the cotton rope be immediately replaced to avoid severe flare-up.

At this point, the hair dressing treatment may be completed without problems. The single headband 13 may be employed throughout the entire cycle in many cases without having to absorb an excess amount of liquids. However, sometimes it is desirable to replace the headband after the rinse step since rinsing sometimes includes a large volume of water. The headband forms a complete hermetic seal when applied to the head.

In a series of ten experiments on customers ranging in age from 18 to 70 years of age, none of the customers experienced flare-up when given a permanent using the device of the present invention. All ten of these customers had previously experienced flare-up using the same solutions and conventional permanent treatment procedures. In addition to the reduction of unsightly and discomforting flare-up, the entire process was much more comfortable. It became apparent that dripping down into the ears and fear of getting solution in the eyes has substantially been eliminated by the device of the present invention.

In addition, the product of this invention is suitable for use by athletes and doctors, in various end uses.

Having thus described the invention, what is claimed is:

1. A headband device for placement about a person's head for absorbing liquids used with hair dressing treatments, comprising:

a fluid impervious barrier layer formed into a strip extending for a distance greater than the circumference of the head, said strip having a width sufficient to define an absorbent holding region and a sealing region;

a moisture pervious fibrous stock sized to cover the absorbent holding region of said strip and having an inside facing region adjacent said absorbent holding region and an outside contact region for contacting the person's head;

an adhesive layer applied to at least one of said absorbent holding region and inside facing region;

a layer of superabsorbent material held in place by said adhesive;

means for bonding said sealing region of said strip at least to said fibrous stock along the length of the strip, to restrict flow of liquids on a person's head to said absorbent region only through said fibrous stock; and adjustable means for fastening said strip to a person's head to present said fibrous stock in contact therewith.

2. The device of claim 1, wherein said barrier layer is formed from a film selected from polypropylene, polyethylene, and mixtures thereof.

3. The device of claim 2, wherein said film is formed from polypropylene.

4. The device of claim 3, wherein said polypropylene is a two temperature co-extrusion film having an inner side with a lower melting temperature.

5. The device of claim 1, wherein said adhesive layer is printed on the inside of said strip.

6. The device of claim 1, wherein said adhesive is printed using a roll coater.

7. The device of claim 1, wherein said superabsorbent material is particulate.

8. The device of claim 7, wherein said particulate superabsorbent is printed on said adhesive.

9. The device of claim 7, wherein said particulate is distributed with a predetermined pattern.

10. The device of claim 1, wherein the ends of said headband are hermetically sealed to prevent flow of liquid out either end thereof.

11. The device of claim 1, wherein said adhesive is printed on the inside facing region of said fibrous stock.

12. The device of claim 1, wherein said moisture pervious fibrous stock is a non-woven stock.

13. The device of claim 12, wherein said fibrous non-woven stock is selected from diaper stock and incontinent pad stock.

14. The device of claim 1, which further includes a plurality of said headbands formed from a continuous strip, said strip having means for separating said plurality of headbands.

15. The device of claim 14, wherein said means for separating said plurality includes a perforated edge and hermetic terminal end seals to prevent liquid flow out either end.

16. The device of claim 1, wherein said adjustable means for fastening said strip to a person's hand comprises contact tabs.

17. A headband device for placement about a person's head for absorbing liquids used with hair dressing treatments, comprising:

a fluid impervious barrier layer formed from a film selected from polypropylene, polyethylene and mixtures thereof into a strip extending for a distance greater than the circumference of the head, said strip having a width sufficient to define an absorbent holding region and a sealing region;

a moisture pervious fibrous stock sized to cover the absorbent holding region of said strip and having an inside facing region adjacent said absorbent holding region and an outside contact region for contacting the person's head;

an adhesive layer printed on said absorbent holding region;

a layer of particulate superabsorbent material printed on said adhesive;

means for bonding said sealing region of said strip at least to said fibrous stock along the length of the strip, to restrict flow of liquids on a person's head to said absorbent region only through said fibrous stock; and adjustable means for fastening said strip to a person's head to present said fibrous stock in contact therewith.

18. The device of claim 17, wherein said film is formed from polypropylene.

19. The device of claim 17, wherein said polypropylene is a two temperature co-extrusion film having an inner side with a lower melting temperature.

20. The device of claim 17, wherein said adhesive is printed on the inside of said strip using a roll coater.

21. The device of claim 17, wherein said ends are hermetically sealed to prevent liquid flow out either end.

22. The device of claim 17, wherein said particulate is distributed with a predetermined pattern.

23. The device of claim 17, wherein said fibrous non-woven stock is selected from diaper stock and incontinent pad stock.

24. The device of claims 17, which further includes a plurality of said headbands formed from a continuous strip, said strip having perforation means for separating said plurality of headbands and hermetic sealed terminal ends to prevent liquid flow out either end.

25. The device of claim 17, wherein said adjustable means for fastening said strip to a person's hand comprises contact tabs.

* * * * *